US009387373B1

(12) United States Patent
DeMille et al.

(10) Patent No.: US 9,387,373 B1
(45) **Date of Patent: *Jul. 12, 2016**

(54) GOLF CLUB HEAD WITH COMPOSITE WEIGHT PORT

(71) Applicant: CALLAWAY GOLF COMPANY, Carlsbad, CA (US)

(72) Inventors: Brandon D. DeMille, Carlsbad, CA (US); William C. Watson, Temecula, CA (US); Patrick Dawson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/657,725

(22) Filed: Mar. 13, 2015

Related U.S. Application Data

(63) Continuation-in-part of application No. 13/451,887, filed on Apr. 20, 2012, now Pat. No. 8,540,588, which is a continuation-in-part of application No. 13/363,551, filed on Feb. 1, 2012, now Pat. No. 8,197,357, which is a continuation-in-part of application No. 13/248,855, filed on Sep. 29, 2011, now Pat. No. 8,444,506, and a continuation-in-part of application No. 12/940,371, filed on Nov. 5, 2010, now Pat. No. 8,414,422, which is a continuation of application No. 13/839,988, filed on Mar. 15, 2013, now Pat. No. 8,979,671.

(60) Provisional application No. 61/388,124, filed on Sep. 30, 2010, provisional application No. 61/286,971, filed on Dec. 16, 2009.

(51) Int. Cl.
*A63B 53/04* (2015.01)
*A63B 53/06* (2015.01)

(52) U.S. Cl.
CPC ..... *A63B 53/0466* (2013.01); *A63B 2053/045* (2013.01); *A63B 2053/0408* (2013.01); *A63B 2053/0433* (2013.01); *A63B 2053/0437* (2013.01); *A63B 2053/0491* (2013.01); *A63B 2209/02* (2013.01)

(58) Field of Classification Search
CPC ..... A63B 53/0466; A63B 2209/02; A63B 2053/0491; A63B 2053/0437; A63B 2053/0433; A63B 2053/045; A63B 2053/0408
USPC ..... 473/324–350, 287–292, 256
See application file for complete search history.

(56) References Cited

U.S. PATENT DOCUMENTS

| | | | | |
|---|---|---|---|---|
| 7,041,189 | B2 * | 5/2006 | Caldwell | A63B 53/0466 156/242 |
| 7,497,788 | B2 * | 3/2009 | Imamoto | A63B 53/0466 473/335 |
| 8,197,357 | B1 * | 6/2012 | Rice | A63B 53/0466 473/334 |
| 8,197,358 | B1 * | 6/2012 | Watson | A63B 53/0466 473/334 |
| 8,235,843 | B1 * | 8/2012 | Rice | A63B 53/0466 473/334 |

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head having a face component, a crown, and a composite sole or a composite body patch with one or more weight ports for receiving one or more weight inserts is disclosed herein. At least part of each of the weight ports is integrally formed in the composite sole or composite body patch, and each of the weight ports include a weight receiving region for receiving a weight and a screw receiving region for receiving a screw that secures the weight in the weight port.

11 Claims, 13 Drawing Sheets

(56) References Cited

U.S. PATENT DOCUMENTS

| | | | | |
|---|---|---|---|---|
| 8,262,506 | B2 * | 9/2012 | Watson | A63B 53/0466 473/334 |
| 8,414,422 | B2 * | 4/2013 | Peralta | A63B 53/0466 473/334 |
| 8,444,506 | B2 * | 5/2013 | Watson | A63B 53/0466 473/334 |
| 8,485,919 | B2 * | 7/2013 | Rice | A63B 53/0466 473/334 |
| 8,540,588 | B2 * | 9/2013 | Rice | A63B 53/0466 473/334 |
| 8,753,226 | B2 * | 6/2014 | Rice | A63B 53/0466 473/334 |
| 8,858,362 | B1 * | 10/2014 | Leposky | A63B 53/0466 473/334 |
| 8,979,671 | B1 * | 3/2015 | DeMille | A63B 53/0466 473/334 |
| 2003/0220035 | A1 * | 11/2003 | Fjare | C08G 18/683 442/103 |

* cited by examiner

GOLF CLUB HEAD WITH COMPOSITE WEIGHT PORT

CROSS REFERENCES TO RELATED APPLICATIONS

The present application is a continuation of U.S. patent application Ser. No. 13/839,988 filed on Mar. 15, 2013, which is a continuation-in-part of U.S. patent application Ser. No. 13/451,887, filed on Apr. 20, 2012, which is a continuation-in-part of U.S. patent application Ser. No. 13/363,551, filed on Feb. 1, 2012, which issued on Jun. 12, 2012, as U.S. Pat. No. 8,198,357, and which is a continuation-in-part of U.S. patent application Ser. No. 13/248,855, filed on Sep. 29, 2011, which claims priority to U.S. Provisional Application No. 61/388,124, filed on Sep. 30, 2010, and is a continuation-in-part of U.S. patent application Ser. No. 12/940,371, filed on Nov. 5, 2010, which claims priority to U.S. Provisional Application No. 61/286,971, filed on Dec. 16, 2009, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a composite sole or composite body patch with one or more weight ports to house one or more removable weights. More specifically, the present invention relates to a golf club head having a composite sole or composite body patch with integrally formed weight ports and a removable, metal weight insert.

2. Description of the Related Art

As driver golf club heads have increased in volume to greater than 300 cubic centimeters, their moments of inertia have also increased, providing greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the front face of the golf club head.

As the center of gravity is positioned further rearward from the front face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness of ball flight. For off-center hits above the sweet spot, the increased gear effect causes reduced backspin, which can cause an undesirable trajectory having insufficient carry length or time of flight, which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head and also to increase the face size without exceeding the upper range of the preferred total golf club head mass. Such mass distributions are dependent on minimum wall thickness values required to achieve acceptable in-service durability.

The practical limitation is that as the face size is increased, hit locations in certain regions around the face perimeter will yield an unsatisfactory ball flight due to the above-mentioned deleterious effects, which are accentuated for larger faces. The deleterious effects increase in a non-linear manner as the distance from the face center increases. Thus the incremental face area gained by increasing face size will be subject to more extreme deleterious effects. This limits the practical length of the club, because probable hit distribution across the surface of the face broadens as the club length increases. As a result, a longer club will yield a larger percentage of hits in the perimeter regions of the face where the deleterious effects occur. This offsets the otherwise beneficial effect of increased head speed. As club length increases, head speed increases up to a length of approximately 52 inches, at which point aerodynamic and biomechanical effects offset the length effect.

Further, conventional head designs having a center of gravity positioned substantially rearward from the face are subject to significant dynamic loft effects, which can be undesirable. Dynamic loft increases with head speed, so that golfers with higher head speeds experience more dynamic loft than those with slower swing speeds. This is opposite of what is desired as higher head speeds generally require less loft, otherwise excess backspin will be generated, which negatively affects trajectory and performance.

Currently, golf club heads made of metal, composite, or other material are produced with a specific weight which is fixed once the golf club head is finished. The fixed weight of the golf club head determines the center of gravity and moment of inertia. After the golf club head is finished, there exists a small amount of weight which needs to be adjusted. This small amount of weight is called the swing weight. Presently, if the swing weight needs to be adjusted, to alter the center of gravity and/or moment of inertia, the fixed weight must be changed, which requires the manufacture of a new golf club head.

One invention that addresses a golf club head with an improved moment of inertia and center of gravity is U.S. Pat. No. 7,559,851 issued to Cackett et al. for Golf Club Head with High Moment of Inertia. This patent discloses a golf club head with a moment of inertia, Izz, about the center of gravity of the golf club head that exceeds 5000 grams-centimeters squared. Another example is U.S. Pat. No. 3,897,066 to Belmont which discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means. Yet another example is U.S. Pat. No. 2,750,194 to Clark which discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

Although the prior art has disclosed many variations of golf club heads with weight adjustment means, the prior art has failed to provide a club head with both a superior material construction and a high-performance weighting configuration.

BRIEF SUMMARY OF THE INVENTION

It is the object of this invention to adjust the swing weight of the golf club head externally, without having to manufacture or purchase a new golf club head. A golfer using the present invention will be able to adjust the center of gravity and moment of inertia to best suit his or her playing needs. The golf club head has external weights positioned at specific locations on the golf club head body to improve the center of gravity and moment of inertia characteristics. The weights to be inserted into the cavities of the golf club head all may be of the same size and shape, but will vary in density. This allows for the weights to be interchangeable depending on the golfer's individual needs. The aft-body of the golf club head is preferably composed of a composite material with recessed cavities to engage the weights and ribs to support the recessed cavities.

One aspect of the invention is a golf club head comprising a face component, a crown, and a composite sole comprising at least one integrally formed weight port and at least one integrally formed rib. In some embodiments, the composite may be SMC, which may comprise chopped fibers, each having a length less than 0.0625 or a length that is no less than 2 inches and no more than 4 inches. In other embodiments, the at least one weight port may comprise first and second weight ports and the at least one rib may comprise a first rib connecting the first weight port to the sole and a second rib connecting the first weight port to the second weight port. In some embodiments, the at least one rib may have a height to width ratio that is greater than 0.5. In further embodiments, the height to width ratio may be at least 3 and no more than 5. In a further embodiment, the height to width ratio may be approximately 4. In some embodiments, the sole may comprise a thickness of less than 0.050 inch. In some embodiments, the composite may be compression molded. In other embodiments, the golf club head may be a wood-type head, such as a driver-type golf club head, having a volume of 120 to 600 cubic centimeters.

Another aspect of the present invention is a driver-type golf club head comprising a metal face component and an composite aft body comprising a crown and a sole, wherein the sole comprises a first weight port and a plurality of ribs, wherein the composite is SMC comprising chopped fibers, each of which has a length that is less than 0.0625 inch, wherein each of the plurality of ribs has a height to width ratio greater than 0.5, wherein each of the plurality of ribs contacts the first weight port, and wherein the plurality of ribs and the first weight port are integrally formed with the sole. In some embodiments, the composite aft body may be compression molded. In other embodiments, the driver-type golf club head may comprise a second weight port in the crown. In some embodiments, the driver-type golf club head may further comprise a screw receiving region, which may be integrally formed with the first weight port.

Yet another aspect of the present invention is a driver-type golf club head comprising a face component comprising a striking surface and a return portion, the face component composed of a titanium alloy, and an SMC composite aft body comprising a crown and a sole, wherein the aft body is compression molded, wherein the sole comprises a first weight port, a second weight port, a first rib, a second rib, and a third rib, wherein the sole has a thickness less than 0.050 inch, wherein the first rib connects the first weight port and the second weight port, wherein the second rib connects the first weight port and the sole, wherein the third rib connects the second weight port and the sole, and wherein each of the first, second, and third ribs has a height to width ratio greater than 0.5. In some embodiments, each of the first, second, and third ribs may have a height to width ratio of greater than 3. In other embodiments, the driver-type golf club head may further comprise at least one metal screw receiving boss, which may be disposed within one of the first and second weight ports.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
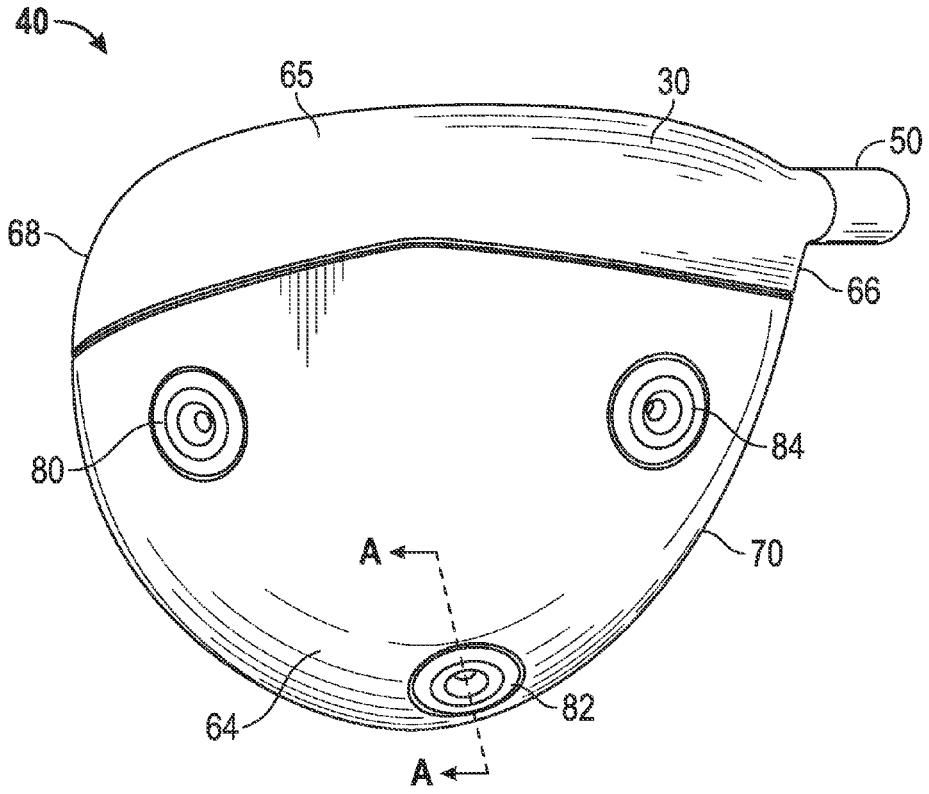
FIG. 1 is sole-side view of a golf club head according to an embodiment of the present invention.
Figure 2:
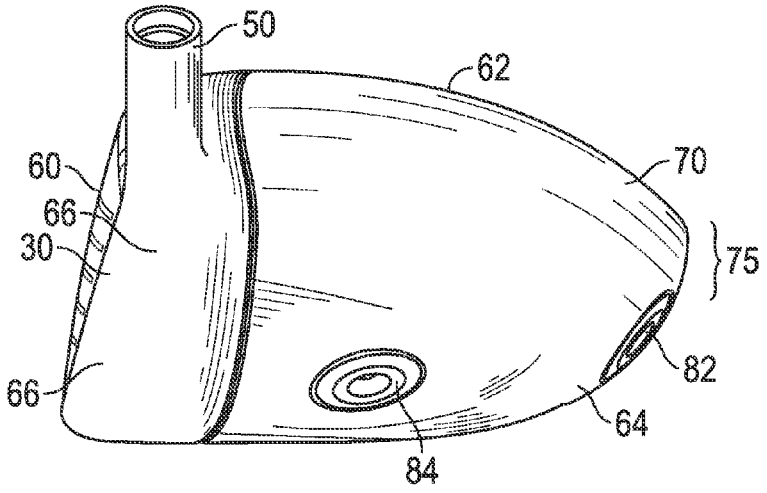
FIG. 2 is a heel-side view of the golf club head shown in FIG. 1.
Figure 3:
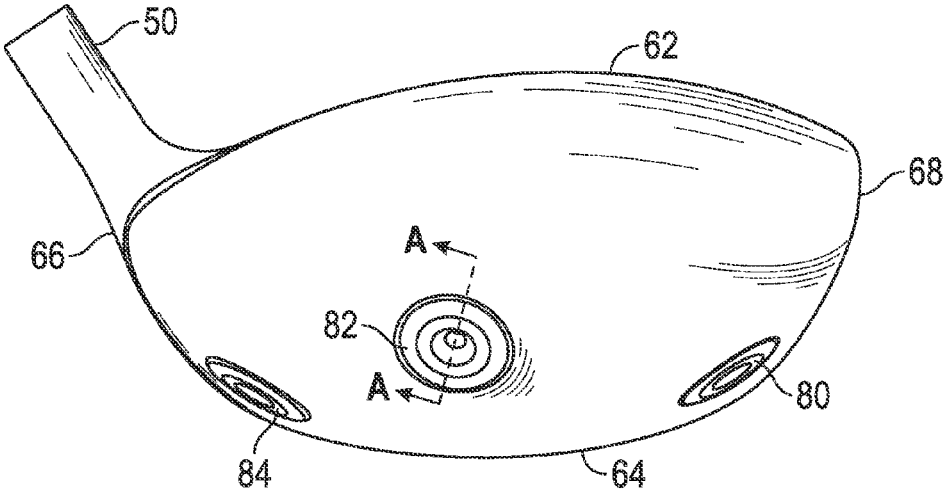
FIG. 3 is a rear view of the golf club head shown in FIG. 1.

The present invention is generally directed to a golf club head with one or more weight ports that are formed in a composite sole or a composite sole patch and house removable weight inserts. In the preferred embodiments, the one or more weight ports are integrally formed in the sole or body patch.

Views of a first embodiment of the present invention are shown in FIGS. 1-5. The golf club head 40 shown in FIGS. 1-3 has a hollow interior 90, shown in FIG. 5, and is generally composed of a face component 30 comprising a face 60, a face extension 65, and a hosel 50, and an aft body 70 comprising a crown 62 and a sole 64 having three weight ports 80, 82, 84. In alternative embodiments, the golf club head 40 may have one, two, or more than three weight ports. The club head 40 also may optionally have a ribbon, skirt, or side portion (not shown) disposed between the crown 62 and sole 64 portions. The golf club head 40 is preferably partitioned into a heel section 66 nearest the hosel 50, a toe section 68 opposite the heel section 66, and a rear section 75 opposite the face 60. The preferred embodiment of the golf club head 40 shown in FIGS. 1-5 has a volume of approximately 460 cubic centimeters and a face 60 with a characteristic time that is close to, but does not exceed, 257 μs.

In the embodiment shown in FIGS. 1-5, the face component 30 is made of titanium and the aft body 70 (including the crown 62 and sole 64) is made of a composite material. The composite crown 62 and sole 64 may be formed using one or more of the techniques described in U.S. Patent Publication Nos. 20100139079 and 20110065528, and U.S. patent application Ser. No. 12/886,773, the disclosures of which are hereby incorporated by reference in their entireties herein.

Figure 4:
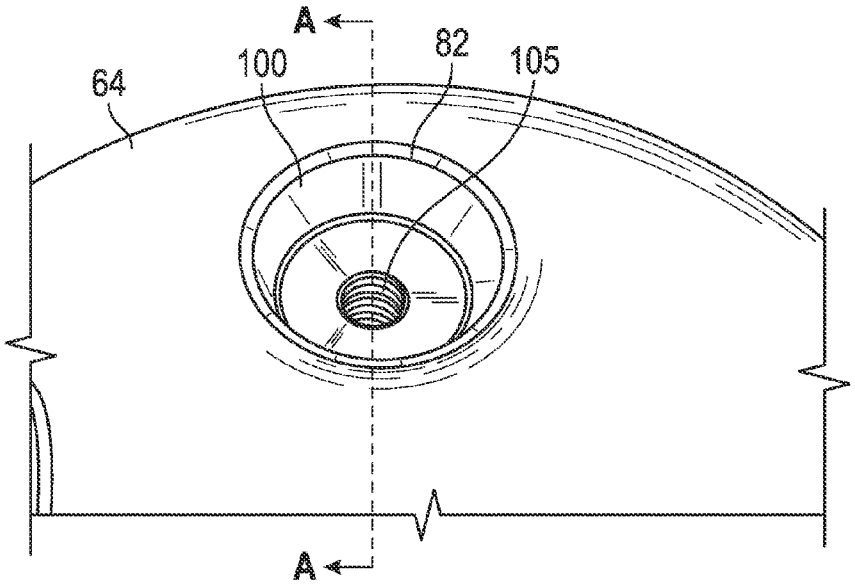
FIG. 4 is a top view of a weight port shown in FIG. 1.
Figure 5:
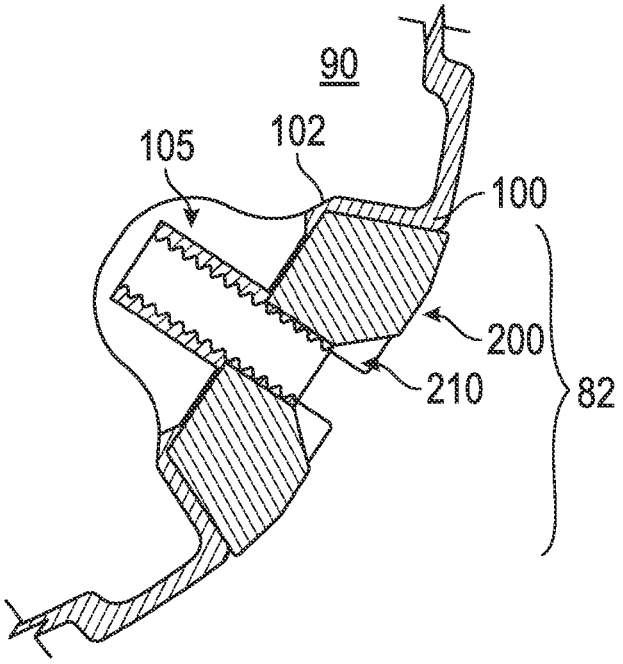
FIG. 5 is a cross-sectional view of the weight port and golf club head shown in FIG. 4 along line A-A.

At least part of each weight port 80, 82, 84 is integrally formed in the composite sole 64. As shown in FIGS. 4 and 5, the weight port 82 comprises a weight receiving region 100 and a screw-receiving region 105. In this embodiment, the weight receiving region 100 is the portion of the weight port 82 that is integrally formed in the composite and the screw-receiving region 105 is a separate metal piece, e.g., a screw-receiving boss with internal threads, which is affixed to the interior surface 102 of the composite weight receiving region 100. The screw-receiving region 105 preferably is affixed to the interior surface 102 of the composite weight receiving region 100 with an adhesive or another means.

Figure 7:
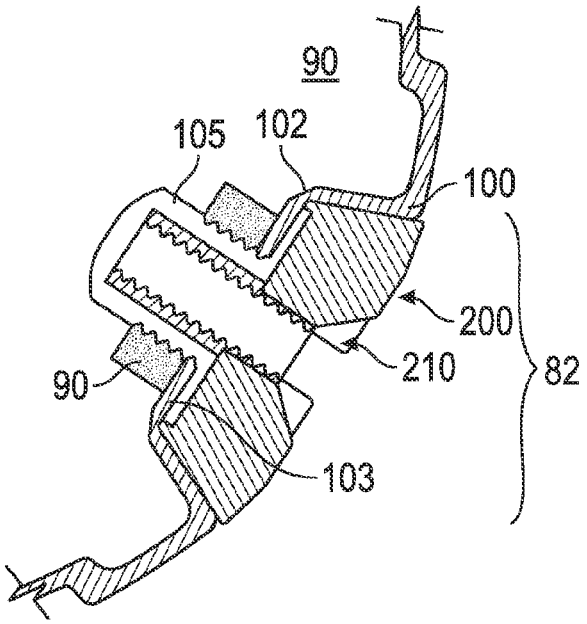
FIG. 7 is a cross-sectional view of an alternative configuration of the weight port and golf club head shown in FIG. 4 along line A-A.

The screw-receiving region 105 may also, in an embodiment shown in FIG. 7, be affixed to the exterior surface 103 of the composite weight receiving region 100 with an adhesive or with a mechanical fastener such as a nut 90, which is affixed to a lower portion of the screw-receiving region 105 to effectively sandwich the weight-receiving region 100 between the screw-receiving region 105 and the nut 90. In this embodiment, the screw-receiving region 105 rests against the exterior surface 103 of the weight receiving region 100 and extends into the golf club head. If the screw-receiving region 105 is mechanically affixed to the weight receiving region 100 in this manner, it is preferable for an exterior surface of the screw-receiving region 105 to have threads so that the nut 90 can securely engage with the screw-receiving region 105. Other techniques of affixing the screw-receiving region 105 to the composite weight receiving region 100 may be utilized. In alternative embodiments, the screw-receiving region 105 may be composed of a material other than metal, such as composite or plastic.

As shown in FIG. 5, a weight 200 is placed into the weight port 82 and received by the composite weight receiving region 100. The weight 200 is secured within the weight port 82 with a screw 210. The weight 200 may be removed from the weight port 82 by unscrewing the screw 210 and removing both the screw 210 and the weight 200 from the weight port 82.

Figure 6:
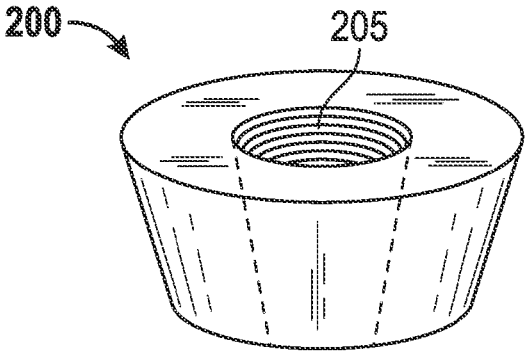
FIG. 6 is a side perspective view of a weight insert that can be used with the golf club head shown in FIG. 1.
Figure 8:
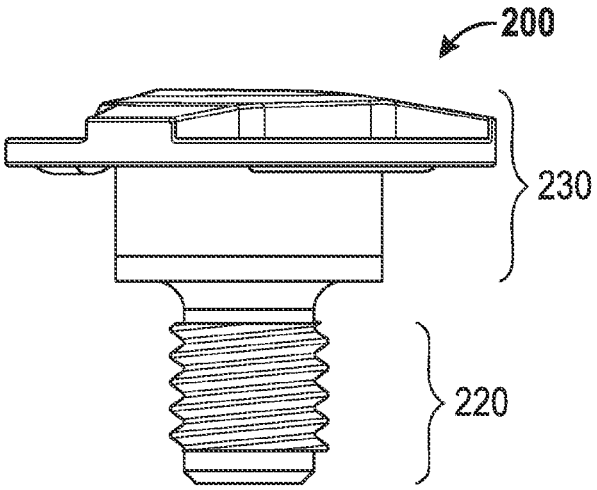
FIG. 8 is a side plan view of an alternative weight that can be used with the golf club head of the present invention.

In the first embodiment, the weight ports 80, 82, 84 are shaped to receive a conical weight. Also in the first embodiment, the weight 200 is conical in shape with a central aperture 205 for receiving a screw 210, as shown in FIG. 6, and both the weight 200 and the screw 210 are composed of a metal material. The weight 200 and screw 210 may, in alternative embodiments, be composed of other materials, such as composite or plastic. In some embodiments, the weight 200 and/or screw 210 may be made of stainless steel, titanium, tungsten, or other metal materials. In an alternative embodiment, the weight 200 may be a different shape, such as asymmetric or cylindrical instead of conical, and may comprise an integrally formed screw portion 220 as shown in FIG. 8, which makes a separate screw 210 unnecessary. In the embodiment shown in FIG. 8, the weight 200 is a weight screw having an integrally formed screw portion 220 and a cylindrical head portion 230.

The weight 200 preferably ranges in mass between 1 grams and 40 grams, more preferably between 10 grams and 30 grams, and most preferably 15 grams to 25 grams. More specifically, if the weight 200 is chosen for insertion in the toe-section 68 weight port 80, the weight 200 preferably ranges in mass between 5 grams and 25 grams, more preferably between 6 grams and 20 grams, and most preferably 6 grams to 16 grams. More specifically, if the weight 200 is chosen for insertion in the heel section 66 weight port 84, the weight 200 preferably ranges in mass between 10 grams and 40 grams, more preferably between 10 grams and 30 grams, and most preferably 12 grams to 29 grams. More specifically, if the weight 200 is chosen for insertion in the rear section 75 weight port 82, the weight 200 preferably ranges in mass between 10 grams and 40 grams, more preferably between 15 grams and 30 grams, and most preferably 23 grams.

Other embodiments of the present invention are shown in FIGS. 9-12. In these embodiments, only a portion of the aft body 70, specifically a body patch 300, is formed of a composite material. The remainder of the aft body 70, which includes a cutout portion 77 in the sole 64 near the toe section 68 of the club head 40, can be composed of any material, but is most preferably composed of a metal alloy, and most preferably a titanium alloy such as 6-4 titanium. The aft body 70 includes a ledge 72 against which the composite body patch 300 rests and to which the composite body patch 300 is bonded. In alternative embodiments, discussed in greater detail herein, the composite body patch 300 may comprise a ledge 305 instead of or in addition to the aft body 70 ledge 72. In alternative embodiments, the cutout portion 77 may be located in an area of the aft body 70 other than the toe section 68. The composite body patch 300 may be formed using one or more of the techniques described in U.S. Patent Publication Nos. 20100139079 and 20110065528, and U.S. patent application Ser. No. 12/886,773, and includes an integrally formed weight port 350 similar or identical to the one described with reference to the embodiments shown in FIGS. 1-5.

Figure 9:
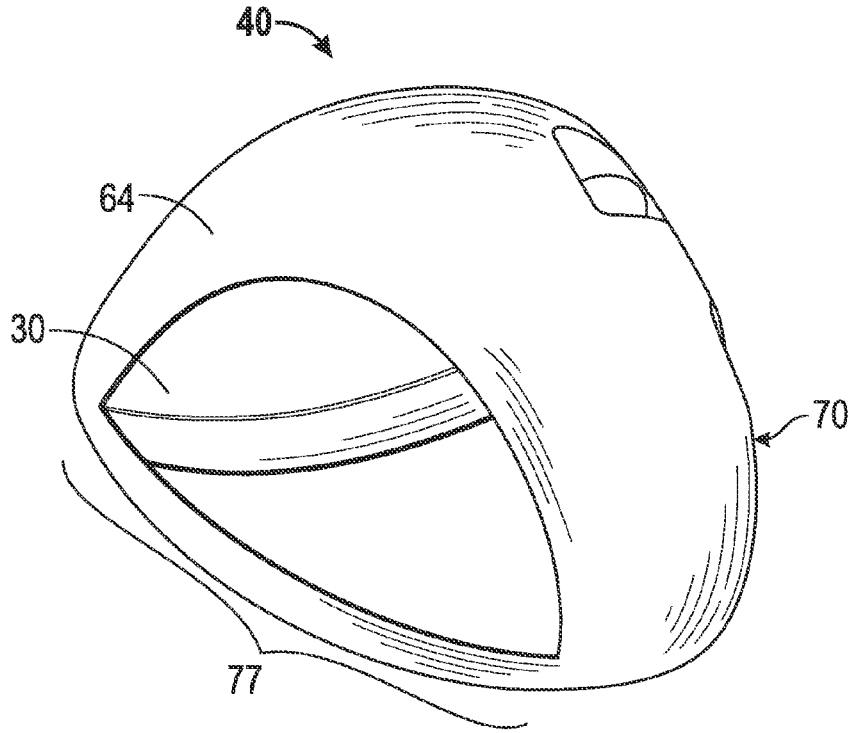
FIG. 9 is a bottom, rear perspective view of a second embodiment of the present invention with an exposed cutout portion.
Figure 10:
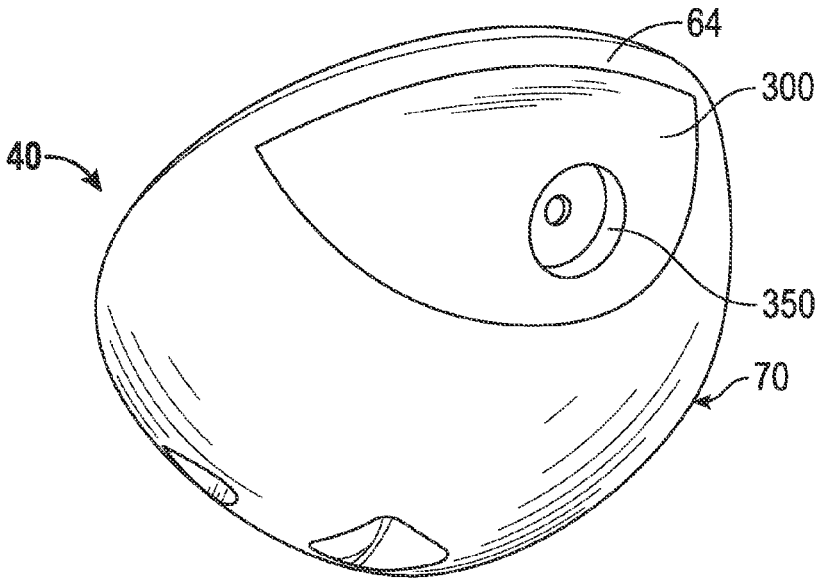
FIG. 10 is a bottom, toe-side perspective view of the embodiment shown in FIG. 9 with the cutout portion covered by a composite body patch.
Figure 11:
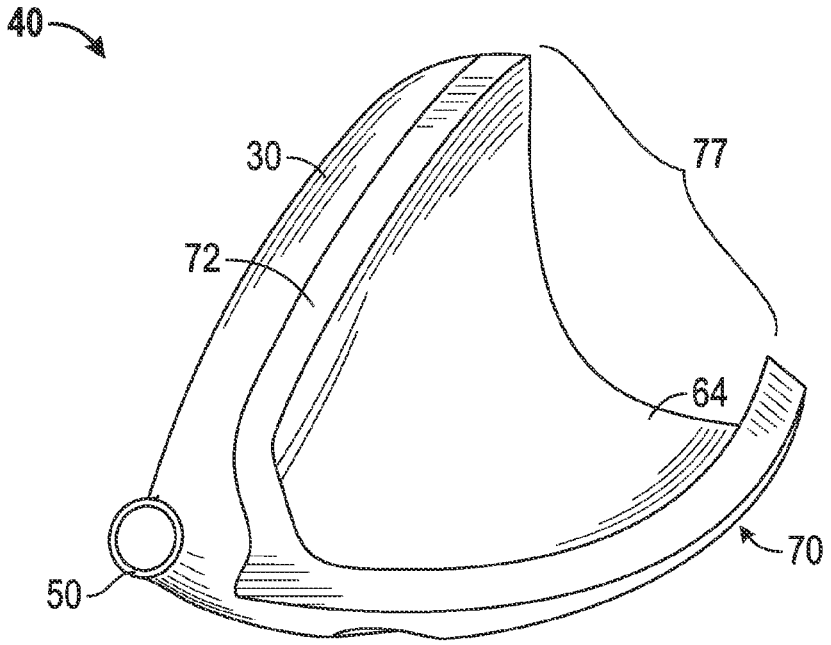
FIG. 11 is top perspective view of a third embodiment of the present invention with an exposed cutout portion.
Figure 12:
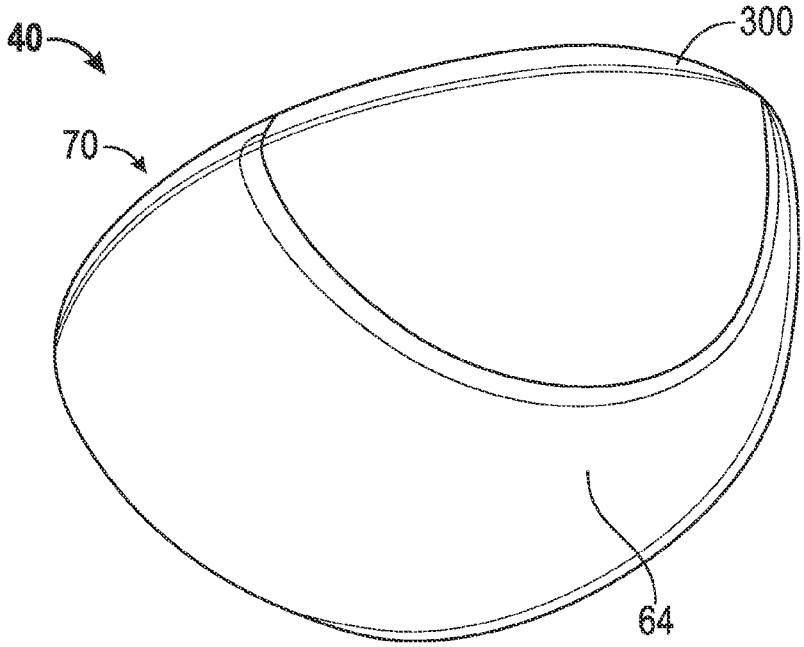
FIG. 12 is a bottom, toe-side perspective view of the embodiment shown in FIG. 11 with the cutout portion covered by a composite body patch.
Figure 13:
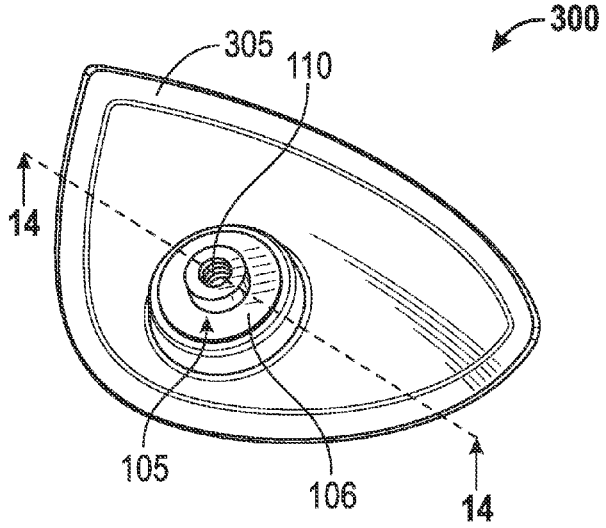
FIG. 13 is a rear perspective view of an embodiment of a composite body patch of the present invention.

As shown in FIGS. 9-12, the composite body patch 300, which preferably has an asymmetric, teardrop shape (but can be manufactured to have any desired shape), is sized to completely cover the cutout portion 77 of the aft body 70, thus preventing dirt and debris from entering the golf club head 40. The composite body patch 300 preferably is permanently affixed to the aft body 70 with an adhesive material. The cutout portion 77 preferably is circumscribed entirely by the material of the sole 64, as shown in FIGS. 9 and 10, but in an alternative embodiment it may be enclosed by the sole 64 on only one or two sides, as shown in FIGS. 11 and 12. In both of these structures, the crown (not shown) may be integrally cast with the rest of the club head, or it may be affixed to the club head 40 after the composite body patch 300 has been bonded to the sole 64. The crown used with this embodiment is preferably composed of a metal alloy material, but it may instead be a composite material formed using one or more of the techniques referenced above.

The composite body patch 300 shown in FIGS. 9-12 may be formed to have a consistent shape and size, such that it can be mass-produced for use in many different club heads. The composite body patch 300 is preferably formed with a ledge 305 to assist in alignment with the aft body 70 of the golf club head 40. The weight port 350 of the composite body patch 300 may have different features, as shown in FIGS. 13-20. In particular, the metal screw-receiving boss 105 may have different configurations and can be affixed to the weight receiving region 100 of the weight port 350 in different ways. The manner in which the metal screw-receiving boss 105 is affixed to the weight port 350 can affect both the durability of the weight port 350 and the retention of the weight 200 within the weight port 350. The features shown in FIGS. 13-20 may be applied to the weight ports 80, 82, 84 disclosed in connection with the first embodiment shown in FIGS. 1-5 in addition to the weight port 350 disclosed in connection with the composite body patch 300.

Figure 14:
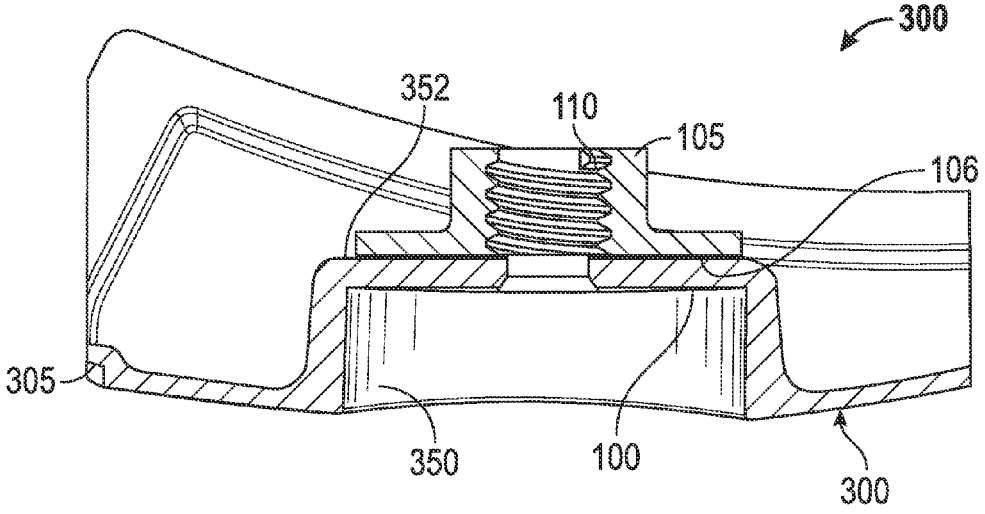
FIG. 14 is a cross-sectional view of the composite body patch shown in FIG. 13 along lines 14-14.
Figure 16:
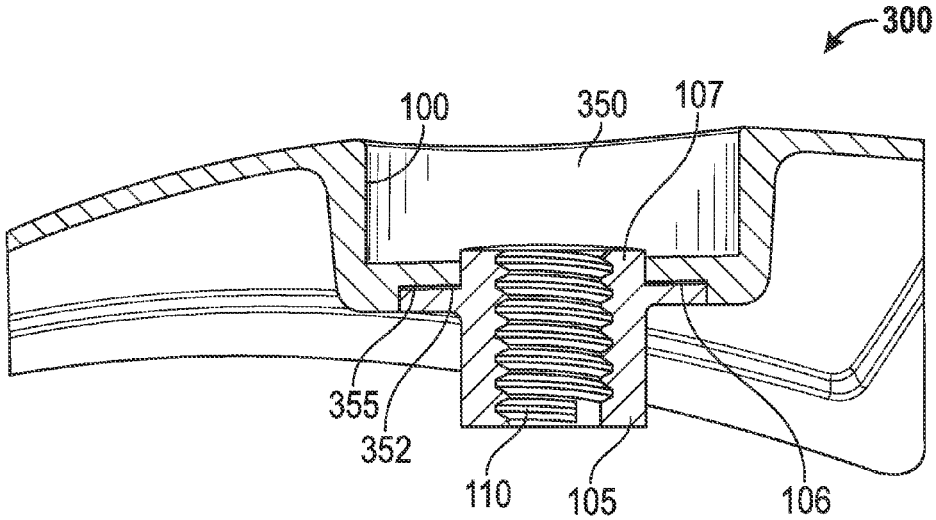
FIG. 16 is a cross-sectional view of the composite body patch shown in FIG. 15 along lines 16-16.
Figure 18:
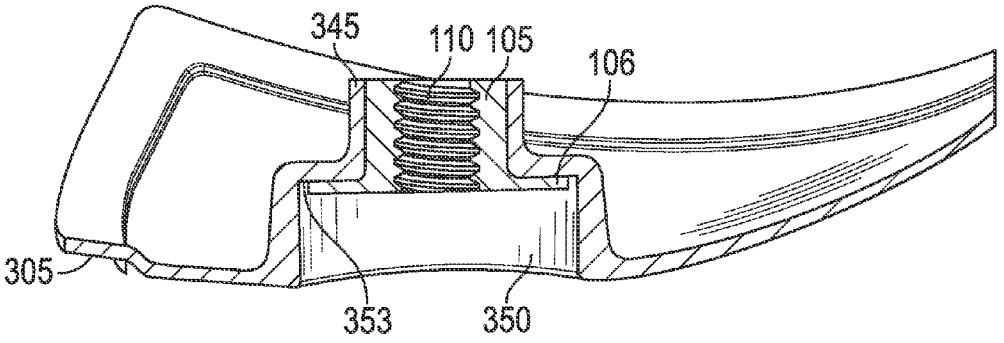
FIG. 18 is a cross-sectional view of the composite body patch shown in FIG. 17 along lines 18-18.

As shown in FIGS. 14, 16, and 18, the metal screw-receiving boss 105 preferably has an upper flange 106 and an internal bore 110 with threads sized to receive either a screw 210 or the integrally formed screw portion 220 of a weight screw. The metal screw-receiving boss 105 preferably is a single piece of metal that is either cast, forged, or machined to have the features described herein. In the embodiment shown in FIGS. 13 and 14, the upper flange 106 of the metal screw-receiving boss 105 is affixed to an interior surface 352 of the weight receiving region 100 of the integrally formed weight port 350. The flange 106 preferably rests against and is bonded to the interior surface 352 with a strong adhesive material. In this configuration, the weight 200, or the cylindrical head portion 230 of a weight screw, never directly touches the metal screw-receiving boss 105, as it is separated from the boss 105 by the composite material of the weight receiving region 100.

Figure 15:
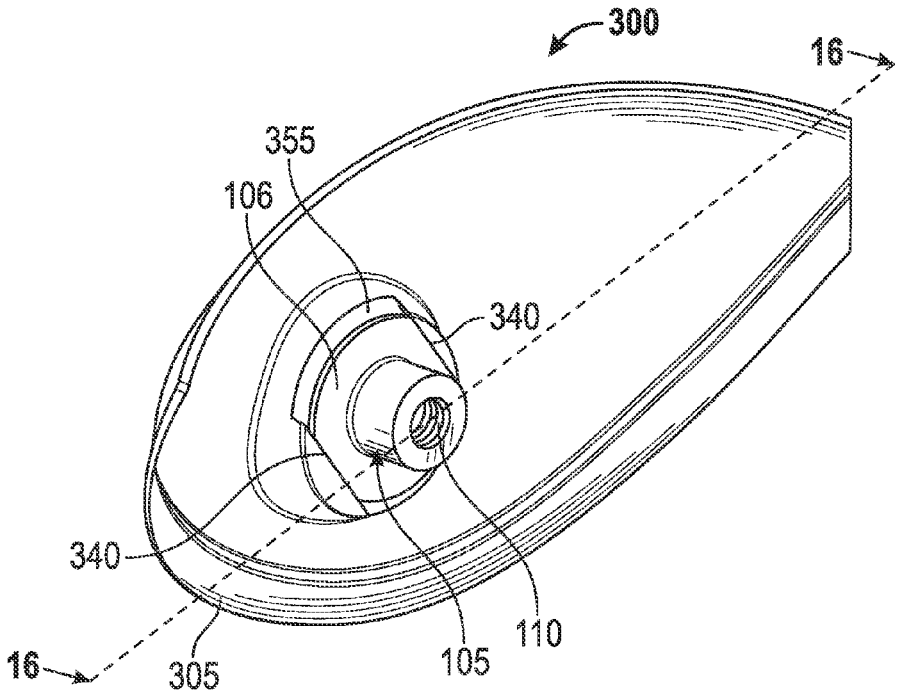
FIG. 15 is a rear perspective view of another embodiment of a composite body patch of the present invention.

In the embodiment shown in FIGS. 15 and 16, the metal screw-receiving boss 105 has a slight "T" shape such that an upper portion 107 extends partly into the weight receiving region 100 of the integrally formed weight port 350. This configuration provides a greater contact surface between the metal screw-receiving boss 105 and the weight port 350, and thus decreases the likelihood that the boss 105, and thus the weight 200, will detach from the weight port 350. The weight 200 will have minimal contact with the boss 105 at the upper portion 107, so a user may wish to insert a washer or o-ring into the weight port 350 to prevent unwanted friction. In this embodiment, the flange 106 rests against and is bonded to the interior surface 352 of the weight receiving region 100 of the weight port 350. As shown in FIG. 15, the interior surface 352 of the weight receiving region 100 has a depression 355 that is sized to receive the flange 106, and also has keyed sides 340 to prevent the metal screw-receiving boss 105 from twisting once it is placed and bonded within the depression 355.

Figure 17:
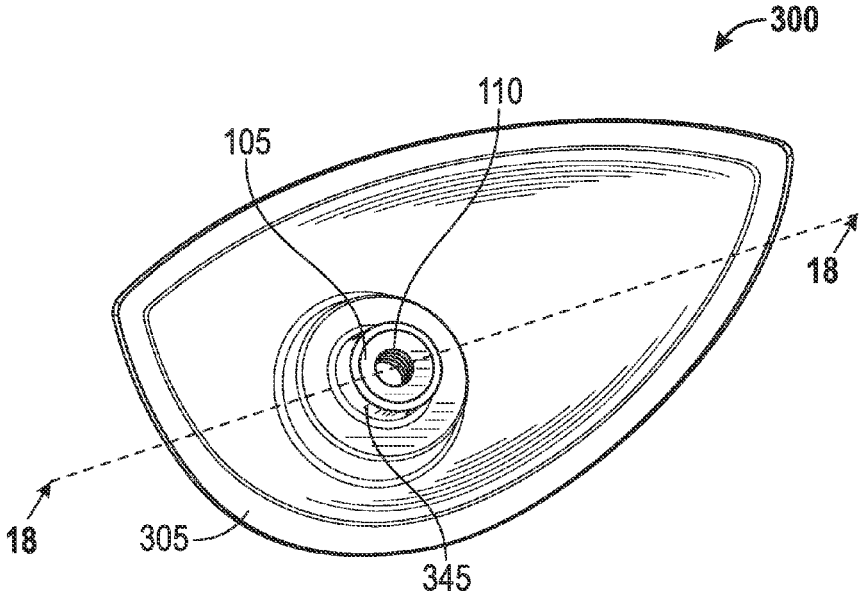
FIG. 17 is a rear perspective view of another embodiment of a composite body patch of the present invention.

The embodiment shown in FIGS. 17 and 18 is similar to the one shown in FIG. 7, as the flange 106 of the metal screw-receiving boss 105 rests against and is bonded to the exterior surface 353 of the weight receiving region 100. In this embodiment, however, the weight receiving region 100 of the weight port 350 has a tube portion 345 extending away from the weight port 350. The metal screw-receiving boss 105 is received within and bonded to the tube portion 345, thus providing significant contact and bonding surface to prevent the boss 105 from disengaging from the weight port 350. In this configuration, the weight 200 directly contacts the boss 105, so a user can place a washer between the boss 105 and the weight 200 to prevent unwanted friction.

Figure 19:
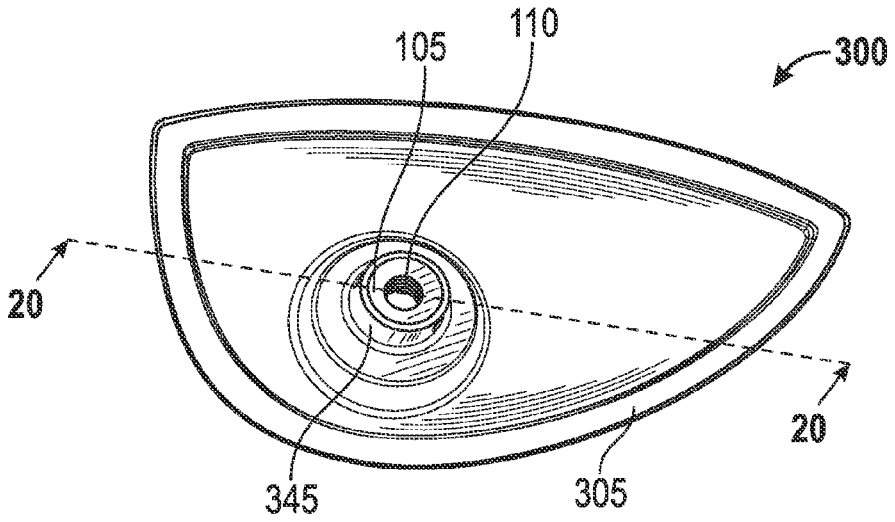
FIG. 19 is a rear perspective view of another embodiment of a composite body patch of the present invention.
Figure 20:
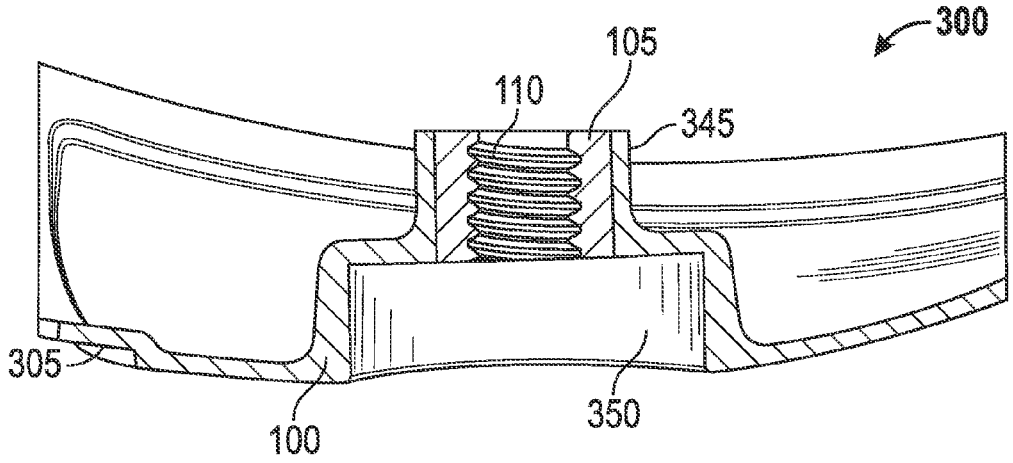
FIG. 20 is a cross-sectional view of the composite body patch shown in FIG. 19 along lines 20-20.
Figure 21:
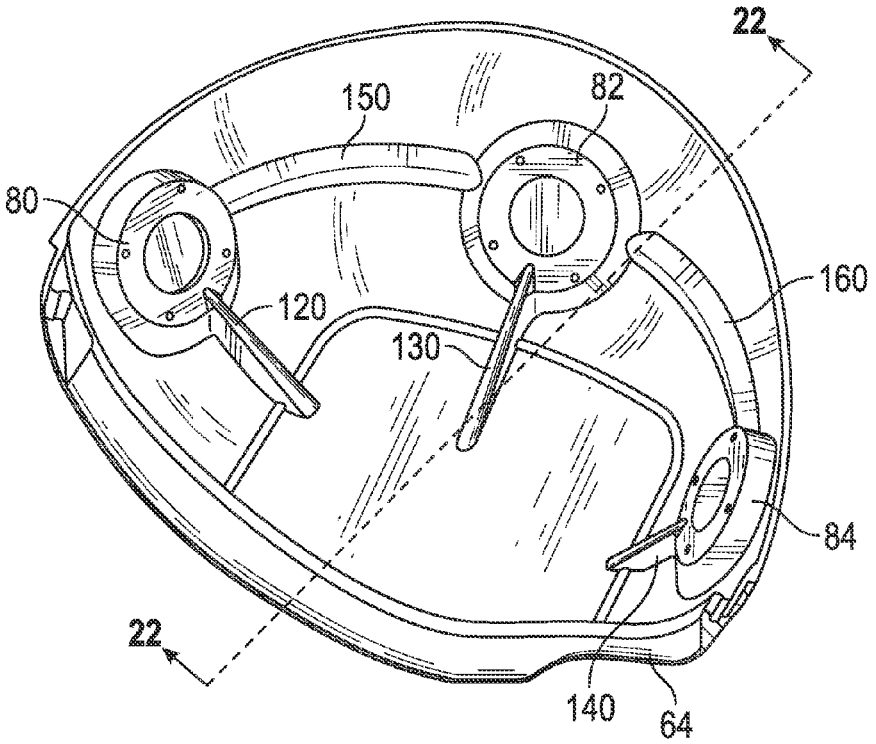
FIG. 21 is a top perspective view of a composite sole according to the preferred embodiment of the present invention.
Figure 22:
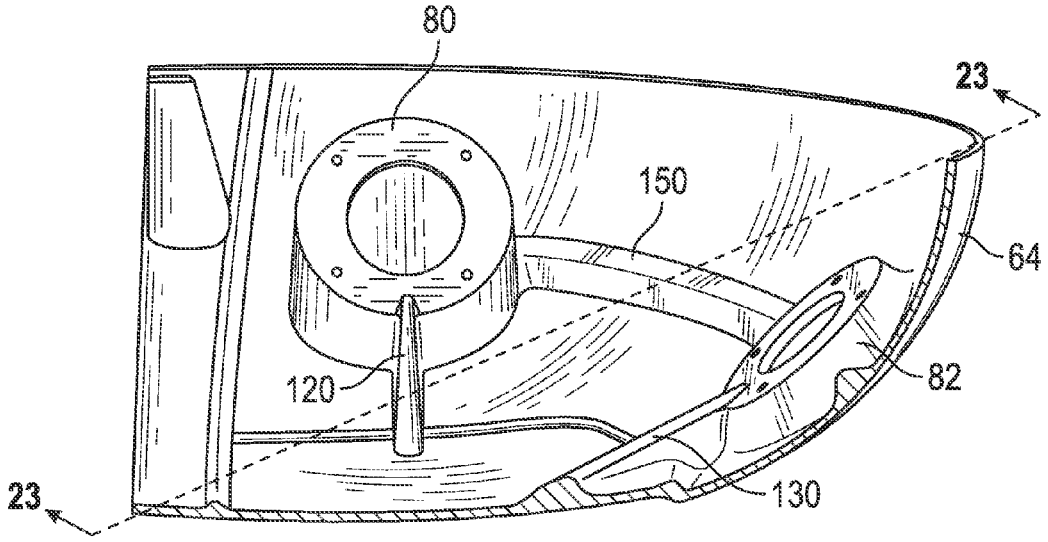
FIG. 22 is a cross-sectional view of the embodiment shown in FIG. 21 along lines 22-22.
Figure 23:
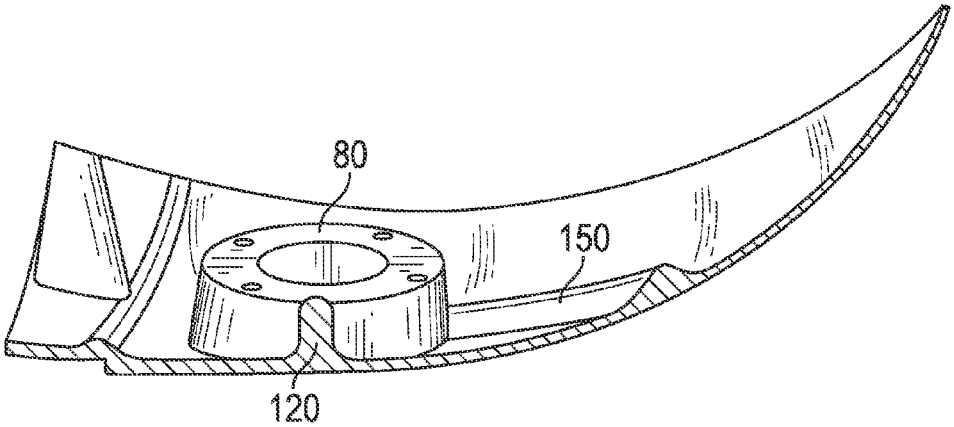
FIG. 23 is a cross-sectional view of the embodiment shown in FIG. 22 along lines 23-23.
Figure 24:
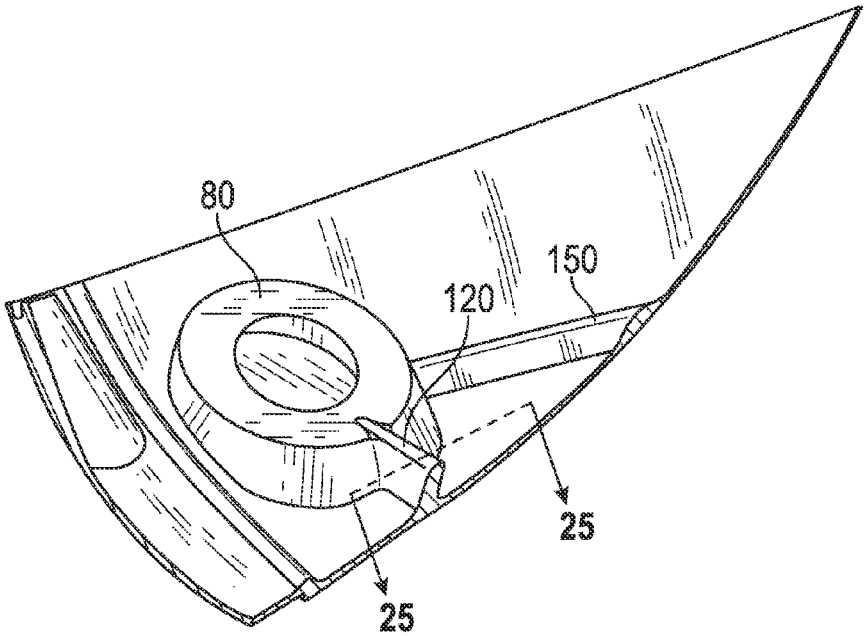
FIG. 24 is an alternative side perspective view of the embodiment shown in FIG. 23.

The embodiment shown in FIGS. 19 to 20 is similar to the embodiment shown in FIGS. 18 and 19, as the weight port 350 also includes the tube portion 345. The boss 105 in this embodiment, however, is much smaller than in the other embodiments because it lacks a flange 106, and is retained entirely within the tube portion 345. This configuration reduces the amount of material needed to form the boss 105, and thus reduces the overall weight of the weight port 350. Furthermore, since the weight 200 will have only minimal contact with the boss, a washer or o-ring is not needed to reduce friction.

A preferred embodiment of the present invention is shown in FIGS. 21-24. In this embodiment, which has the body composition shown in FIGS. 1-4, and may incorporate any of the boss 105 configurations disclosed in connection with the other embodiments disclosed herein and shown in FIGS. 5, 7, and 13-20, or have a composite screw receiving region 105 that is integrally formed with the weight port, the weight ports 80, 82, 84 are supported by composite ribs 120, 130, 140, 150, 160 that are integrally formed with the composite sole 64. These types of raised features are an efficient way to increase local bending stiffness in a thin-walled part such as the weight ports 80, 82, 84 and sole 64 of the present invention. In addition to supporting the weight ports 80, 82, 84, the ribs 120, 130, 140, 150, 160 of the present invention improve the acoustic performance of the golf club head.

Composite golf club components typically are made of prepreg plies, thin sheets of continuous fiber and matrix that are stacked on top of one another to create a laminate and are then formed into a shape to create a part. It is not practical, however, to stack more than a few additional layers over a very small surface area in order to locally change wall thickness. For at least this reason, tall, narrow ribs are not found in parts made exclusively with prepreg. In contrast, sheet molding compound (SMC) typically consists of a matrix material and chopped fibers, which can be very short (less than 1/16 inch), very long (2-4 inches), or somewhere in between. SMC materials flow during molding and are able to fill parts that laminates cannot, and thus preferably are the materials that are used to create the features, particularly the ribs, bosses/screw receiving regions, and weight ports, of the embodiments of the present invention. SMC also has a better strength to weight ratio than titanium, which is typically used to create golf club heads with weight ports and ribs, and thus presents an improvement over the prior art.

Figure 25:
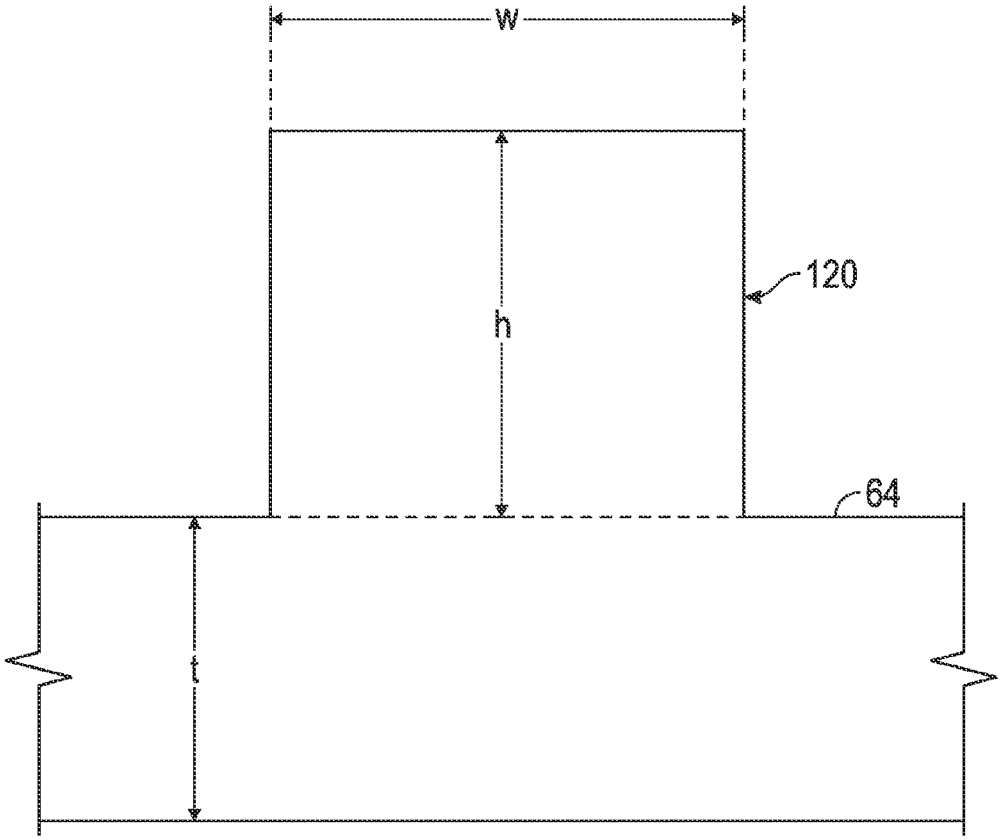
FIG. 25 is a cross-sectional view of the embodiment shown in FIG. 24 along lines 25-25.

As shown in FIGS. 21-24, certain of the ribs 120, 130, 140 of the present invention extend between the weight ports 80, 82, 84 and the sole 64, while other ribs 150, 160 connect the ribs to one another for added resilience and strength. Each of the ribs 120, 130, 140, 150, 160 preferably has the dimensions shown in FIG. 25, with a sole 64 wall thickness t, a rib height h, and a rib width w. As the ratio h/w increases, molding the composite becomes more difficult; in fact, composite laminates have a ratio of h/w that is limited to 0.5 or less. In the preferred embodiment, however, high fiber content SMC is used, so the h/w limit approaches 5. Molding parts with a high h/w ratio is especially difficult when t is small. The increase in h/w provided by SMC allows for very efficient local increases in bending stiffness in the ribbed regions of the golf club head 40, and also allows the construction of ribs connected to thin walls. For example, the preferred embodiment of the present invention has ribs with h/w ratios above 0.50, preferably between 3 and 5, and most preferably 4, while having a sole 64 wall thickness t of less than 0.050 inches.

In other embodiments, the face component 30 and crown 62 may be made from cast or forged metals or from composite materials, and may be formed integrally or pieced together. In yet other embodiments, the face component 30 and crown 62 each may be composed of different materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

Another aspect of the golf club head 40 of the present invention is directed a golf club head 40 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 40 preferably has a coefficient of restitution ranging from 0.80 to 0.94, as measured under conventional test conditions.

The coefficient of restitution of the club head 40 of the present invention under standard USGA test conditions with a given ball preferably ranges from approximately 0.80 to 0.94, more preferably ranges from 0.82 to 0.89 and is most preferably 0.86.

As defined in *Golf Club Design, Fitting, Alteration & Repair,* $4^{th}$ Edition, by Ralph Maltby, the center of gravity, or center of mass, of the golf club head 40 is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 40 are preferably measured using a test frame ($X^T$, $Y^T$, $Z^T$), and then transformed to a head frame ($X^H$, $Y^H$, $Z^H$). The center of gravity of a golf club head 40 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head 40, the scales allow one to determine the weight distribution of the golf club head when the golf club head 40 is placed on both scales simultaneously and weighed along a particular direction, the X, Y or Z direction.

In general, the moment of inertia, Izz, about the Z axis for the golf club head 40 of the present invention is preferably greater than 3000 g-cm$^2$, and more preferably greater than 3500 g-cm$^2$. The moment of inertia, Iyy, about the Y axis for the golf club head 40 of the present invention is preferably in the range from 2000 g-cm$^2$ to 4000 g-cm$^2$, more preferably from 2300 g-cm$^2$ to 3800 g-cm$^2$. The moment of inertia, Ixx, about the X axis for the golf club head 40 of the present invention is preferably in the range from 1500 g-cm$^2$ to 3800 g-cm$^2$, more preferably from 1600 g-cm$^2$ to 3100 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a titanium alloy face component;

a crown;

a sole comprising at least one integrally formed weight port and at least one integrally formed rib; and a weight sized to fit within the at least one weight port, wherein the sole is composed of an SMC composite comprising chopped fibers, each of which has a length that is less than 0.0625 inch, wherein the at least one weight port comprises a screw receiving region and a weight receiving region, wherein the at least one rib has a height to width ratio that is greater than 0.5, and wherein the sole is compression molded and has a thickness of less than 0.050 inches.

2. The golf club head of claim 1, wherein the at least one weight port comprises first and second weight ports, and wherein the at least one rib comprises a first rib connecting the first weight port to the sole and a second rib connecting the first weight port to the second weight port.

3. The golf club head of claim 1, wherein the height to width ratio is at least 3 and no more than 5.

4. The golf club head of claim 3, wherein the height to width ratio is approximately 4.

5. The golf club head of claim 1, wherein the golf club head is a wood-type head having a volume of 120 to 600 cubic centimeters.

6. The golf club head of claim 5, wherein the golf club head is a driver-type golf club head.

7. A driver-type golf club head comprising:

a metal face component;

a crown;

a composite sole comprising at least one sole weight port and a plurality of ribs; and a weight sized to fit within the at least one sole weight port, wherein the composite sole is compression molded, wherein each of the plurality of ribs has a height to width ratio of at least 3 and no greater than 5, wherein each of the plurality of ribs contacts the at least one sole weight port, and wherein the plurality of ribs and the first at least one sole weight port are integrally formed with the sole.

8. The driver-type golf club head of claim 7, wherein the crown comprises at least one crown weight port.

9. The driver-type golf club head of claim 7, further comprising a screw receiving region.

10. The driver-type golf club head of claim 9, wherein the screw receiving region is integrally formed with the at least one sole weight port.

11. The driver-type golf club head of claim 9, wherein the screw receiving region is a metal boss comprising internal threads, and wherein the metal boss is affixed to the at least one sole weight port with an adhesive material.

* * * * *